US005096190A

United States Patent [19]

Montgomery

[11] Patent Number: 5,096,190

[45] Date of Patent: Mar. 17, 1992

[54] METHOD AND APPARATUS FOR SHOULDER MUSCLE EXERCISE

[76] Inventor: Teddy R. Montgomery, P.O. Box, Incline Village, Nev. 89450

[21] Appl. No.: 161,145

[22] Filed: Feb. 26, 1988

[51] Int. Cl.[5] ..... A63B 21/06

[52] U.S. Cl. ..... 272/117; 272/122

[58] Field of Search ..... 272/93, 116, 117, 119, 272/122, 123, 143, 145

[56] References Cited

U.S. PATENT DOCUMENTS 1,007,526 10/1911 Caro ..... 272/93 X
2,617,650 11/1952 Lanelis ..... 272/122
3,019,019 1/1962 Forte ..... 272/117
3,294,399 12/1966 Cugliari ..... 272/117
4,121,827 10/1978 Weider ..... 272/143 X
4,345,756 8/1982 Hoagland ..... 272/117
4,537,394 8/1985 Golinsky, Jr. ..... 272/143 X

*Primary Examiner*—Robert Bahr
*Attorney, Agent, or Firm*—Herbert C. Schulze

[57] ABSTRACT

A method together with an apparatus for exercising shoulder muscles wherein a weight is utilized by hanging over the upper arm and the hand of the same arm controls and manipulates the weight and the shoulder muscle system by movement of the hand and arm cooperatively with the weight.

1 Claim, 2 Drawing Sheets

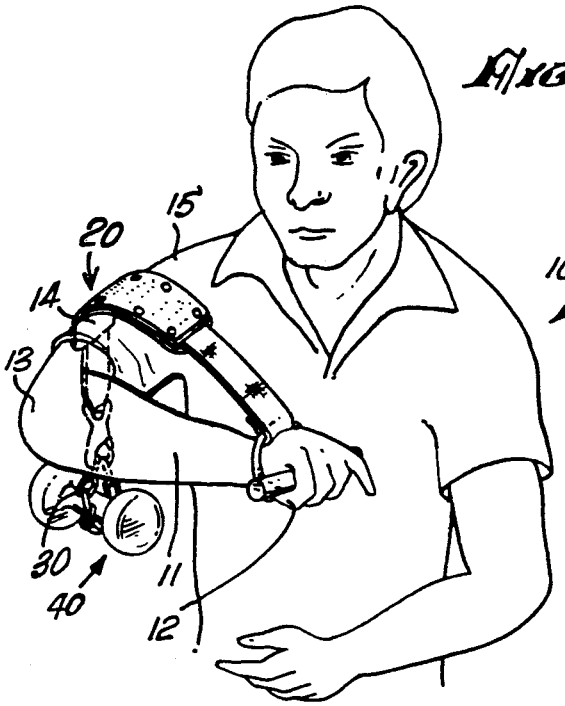
FIG. 1.
10
11
12
13
14
15
20
30
40
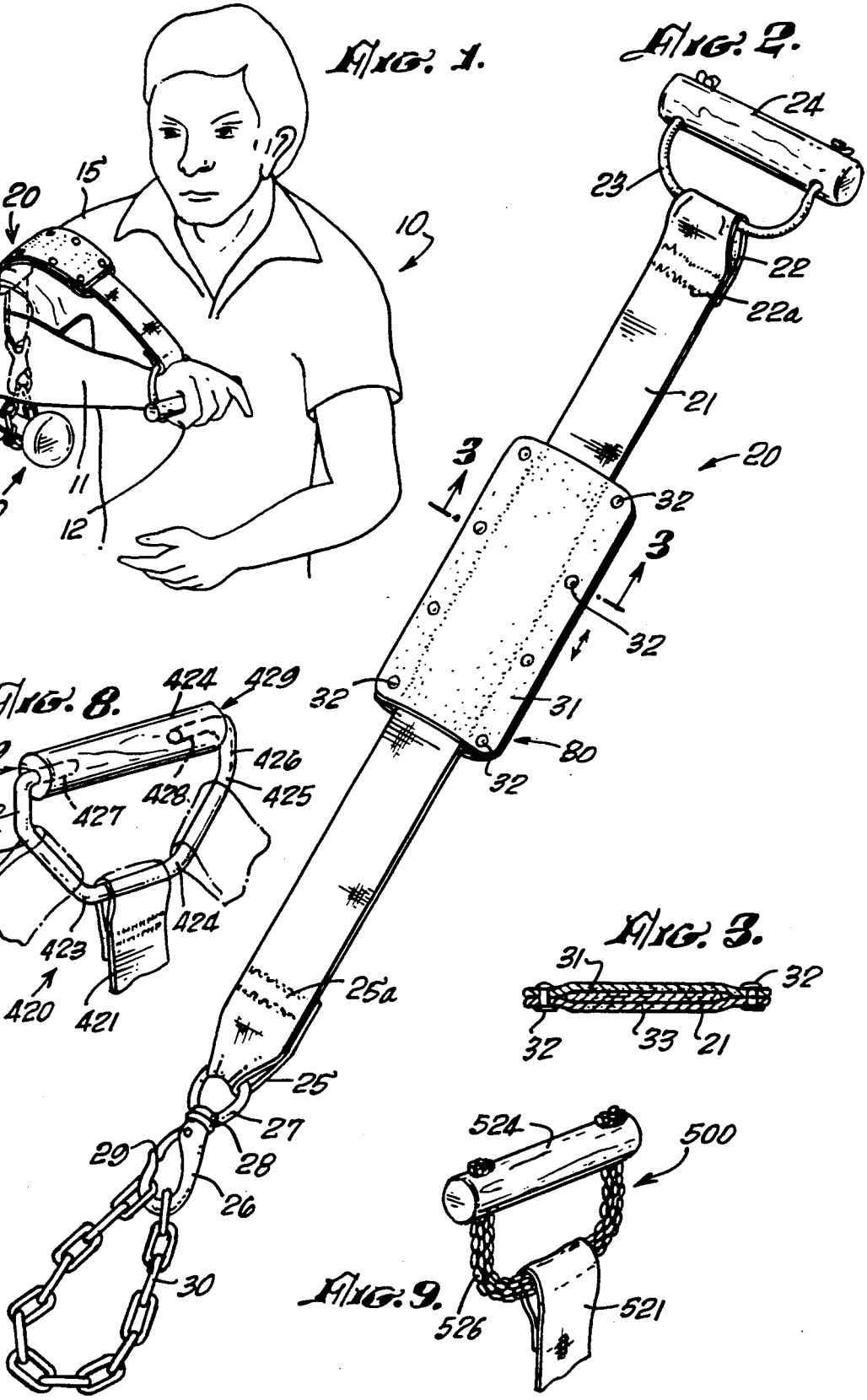
FIG. 2.
20
21
22
22a
23
24
25
25a
26
27
28
29
30
31
32
33
80
3
FIG. 8.
420
421
422
423
424
425
426
427
428
429
FIG. 3.
21
31
32
33
FIG. 9.
500
521
524
526

124
122
123
122a
120
121
125a
125
127
128
129
126
130

224
220
280
221
233
240
280
231
232

121
121a 321
330
331
340

METHOD AND APPARATUS FOR SHOULDER MUSCLE EXERCISE

CROSS REFERENCE TO RELATED PATENT APPLICATIONS

There are no patent applications filed by me related to this application except for design patent application for MUSCLE TRAINING DEVICE being filed concurrently herewith.

BACKGROUND OF THE INVENTION

1. Field of the Invention

This invention is in the general field of exercise and muscle development; The invention is more particularly directed to a method and apparatus for use in development of the upper arm, shoulder and the neck muscles; The invention is even more particularly directed to a method wherein a single arm is utilized to manipulate the muscles of the shoulder and neck associated with that arm by utilizing a weight carried by a sling over the arm and controlled by the hand of the same arm.

2. Description of the Prior Art

There is no prior art known to me which utilizes the weight in a sling over an arm to exercise the shoulder, upper arm and neck muscles.

SUMMARY OF THE INVENTION

The proper development of the shoulder and neck and upper arm muscles is of particular importance for many sports such as, but not limited to, tennis, golf, basketball, and the like. These particular muscles, however, are particularly difficult to develop with most existing exercise equipment or methods of exercise. It is difficult to exercise those particular muscles rotationally or otherwise with force resisting the exercise, except by expensive, generally permanently installed equipment.

I have studied the exercise of various muscles of the human body at some length, and have concentrated on this area which is so difficult to properly exercise.

I have finally conceived and developed a method, and an apparatus for practicing such a method, which provides exercise for the muscle development desired in a unique and very effective manner.

I have accomplished this by providing a sling suitable to pass over the upper arm with a handle suitable to be held by the hand of the same arm which is being exercised, and a means for attaching various weights to the sling in such a manner that gradual development and increasing development of the upper arm, shoulder, and neck muscles may be accomplished.

The sling which I use is provided with a padded area, which may be adjusted if desired, so that the sling does not cut into or cause discomfort to the arm over the portion upon which it rests. The preferred method of utilizing different weights is to utilize ordinary dumbbells of different sizes as the weight carried by the sling. Other weights can be used, but this is a particularly advantageous manner of adjusting the weights, and because of their shape they are easily held in place without danger of slipping off and injurying the person practicing this method.

It is an object of this invention to provide a method for rotational and other exercise for the upper arm, shoulder, and neck muscles of a human being.

Another object of this invention is to provide an apparatus suitable to practice the method heretofore mentioned.

Another object of this invention is to provide such a method and apparatus as have been described wherein the degree of exercise is suitable to be gradually altered in order to gradually increase the effect of the exercise.

The foregoing and other objects and advantages of this invention will become apparent to those skilled in the art upon reading the description of a preferred embodiment which follows, in conjunction with a review of the appended drawings.

BRIEF DESCRIPTION OF THE DRAWINGS

FIG. 1 illustrates in perspectus schematic view an individual utilizing an apparatus to practice the method of this invention;

FIG. 2 is a perspective view of a preferred apparatus to practice the method of this invention;

FIG. 3 is a section on 3—3 of FIG. 2;

FIG. 8 is a perspective of an alternate embodiment of a handle to be used in the various embodiments of this apparatus; and FIG. 9 is still another alternate embodiment of the handle portion of the apparatus used to practice the method of this invention.

DESCRIPTION OF A PREFERRED EMBODIMENT

Figures 4, 5, 6, 7:
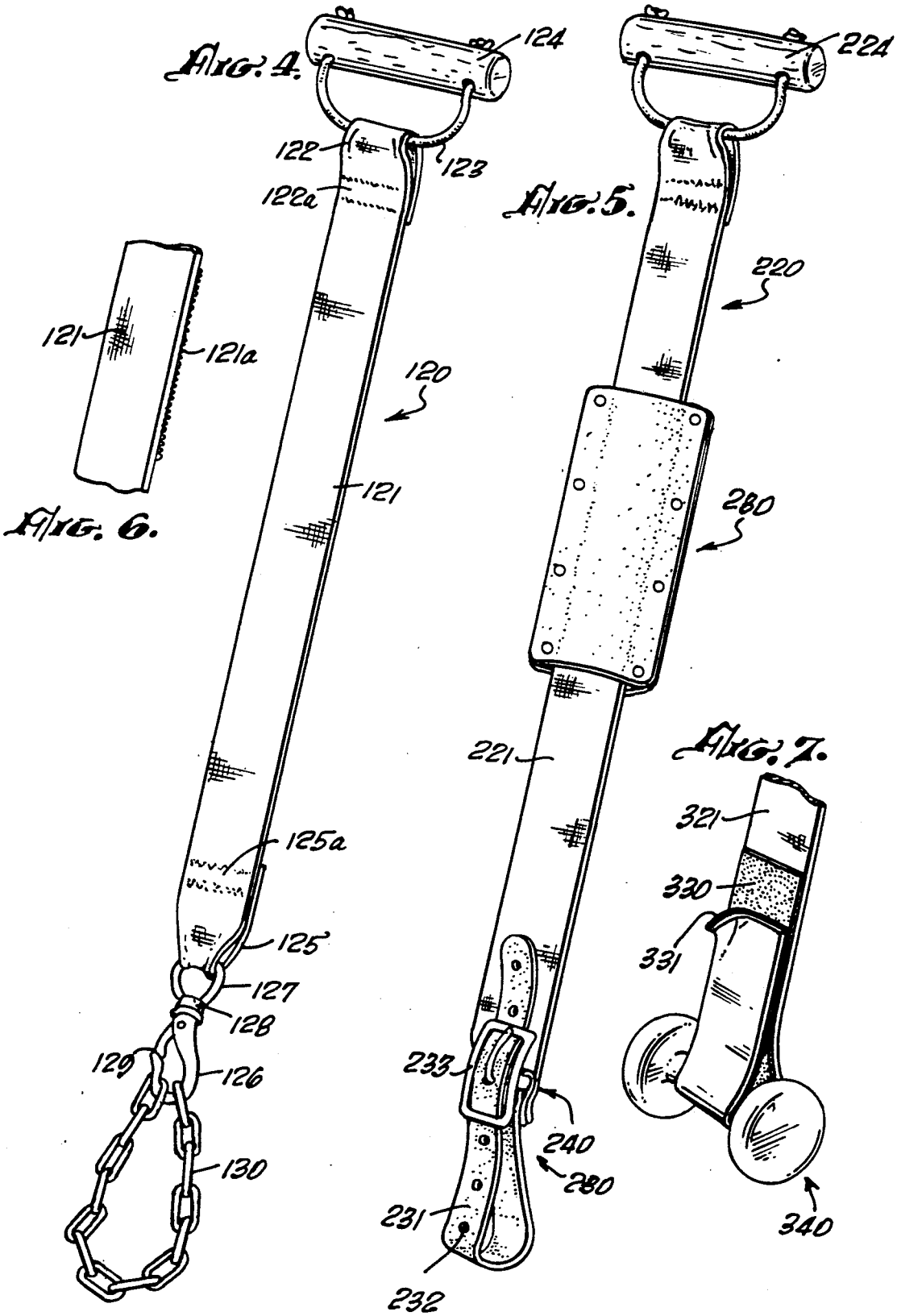
FIG. 4 is an alternate embodiment of the apparatus of FIG. 2.
FIG. 5 is another alternate embodiment of the apparatus of FIG. 2.
FIG. 6 is a fragmentary explanatory perspective of the material used for the shoulder strap in the embodiment of FIG. 4.
FIG. 7 is another alternate embodiment of the weight holding device.

FIG. 1 illustrates an individual generally 10 practicing the method of this invention by the use of an exercising strap generally 20 over the arm 14 and between the shoulder 15 and elbow 13. In FIG. 1 the handle on the apparatus is being held by the hand 12 of the individual 10 who is exercising. The weight generally 40 in the shape of a dumbbell is being carried by the chain carrier generally 30.

FIG. 2 illustrates the elements of a preferred embodiment of a strap suitable to practice the method of this invention in the exercising of the arm and associated shoulder and neck muscles.

The apparatus generally 20 comprises a strap 21 at a first end fastened about a rope 23 by means of being looped as at 22 and held together by stitching or the like 22*a*. The rope 23 is fastened into the handle 24.

At the opposite end of the apparatus shown in FIG. 2 another loop has been formed at 25 by stitching or the like at 25*a*, and connected to a loop 26 preferably with a rotatable connecting joint 28 fastened to a snap holder 26 with the snaps shown at 29. A chain 30 is in place within the snap hook and will accommodate and receive the dumbbell weight 40 as shown in FIG. 1.

FIG. 3 is a section on 3—3 of FIG. 2 and shows a strap 21 which can be of canvas, plastic, leather or other material. It shows the sleeve generally 80 which is comprised of a pair of soft materials such as suede leather or the like 31 and 33 surrounding the strap 21 and held in place by riveted connections or the like at 32. This pad generally 80 can slide upon the strap 21 until it is in the position most comfortable for exercising and will prevent cutting into or discomfort against the arm 14 of the individual using the device.

FIG. 4 illustrates an alternate embodiment of the apparatus in which the handle 124 with the rope 123 of the equivalent of 24 and 23 in FIG. 2. The loops 122 and 125 and the stitching at 122*a* and 125*a* are similar to those numbered 22*a* and 25*a* of FIG. 2. Likewise, the connection at the end 127, 128, 126, 129, and 130 are similar in function to those illustrated at FIG. 2 by reference numerals 27, 28, 26, 29, and 30.

The uniqueness lies in the strap 121 which must be viewed not only on FIG. 4 but also on FIG. 6. The strap 121 will have a roughened, but comfortable area 121*a* on the side which touches the arm. This will avoid slippage of the position of the strap during the exercising. This material 121*a* can be a felt like material or other materials known to those skilled in the art which will be comfortable but will not slip when in contact with the arm of the individual.

FIG. 5 shows another alternate embodiment of this invention wherein the apparatus generally 220 comprises a strap 221 a sliding protective sleeve 280 handle 224 and weight holding apparatus generally 230. In this particular case the weight holding apparatus is a belt like extension having a buckle 233 which includes a tongue suitable to be inserted in the holes 232 in the strap material 231. Thus the weight can be placed within that strap if desired rather than in the chain arrangement previously shown.

FIG. 7 shows still an alternate embodiment of the weight handling portion of the end of the strap wherein the weight 340 is held by strap 321 which has attached to its end two pieces of velcro like material 330 and 331 which can be looped together, one side being felt, the other side consisting of hooks as is well known in the velcro art, and thus it is possible to adjust easily to different sizes of weights used on the end of the exercise device.

FIG. 8 shows an alternate handle which could be used in any of the embodiments heretofore shown wherein the handle 424 has openings at 429 into which extend extensions of a rigid material such as steel or the like which is bent in the configuration as shown and has two ends at 427 and 428 which enter the two holes 429 in the handle. The particular shape having a vertical extension at 422 and 426 and a horizontal mid-piece between the bent portions 423 and 424 results in the angular side elements 425 so that the strap 421 (the equivalent of 21, 221, and 321 in the various embodiments), if this handle is used, may be switched from the horizontal position between the bent portions 423 and 424 and the two angular members 425 for different angles of stress of the weight while being used by the person exercising.

It is noted that a roughened surface has been shown to prevent slippage on the embodiment illustrated in FIG. 4. Likewise a similar roughened edge may be formed on the lower portion 33 of the sleeve shown in the embodiment of FIG. 2 as well as the sleeve in the embodiment of FIG. 5. Such a roughened area can be used to reduce the possibility of slippage if desired.

Another alternate embodiment which can be used to effectively alter the positioning of the strap in this case shown as 521 is illustrated in FIG. 9 wherein the handle 524 merely has attached to it a multibraided rope generally 500, the multibraids being shown at 526. This material as will be known to those skilled in the art has a tendency to grip a material such as canvas, leather, or the like in the strap 521 in this illustration so that it can be shifted and it will not slip upon the rope.

In the use of this apparatus and the method herein disclosed, the user will generally be in the approximate position as shown in FIG. 1 and will both pull and twist with his hand 12 so that the weight 40 will in fact exert differing weights and tensions within the overall arm muscular system extending through the shoulder and to the neck. As shown in FIG. 1, the upper arm will be depending slightly from the shoulder so that the forearm takes a position roughly parallel to the arm pits with the hand approximately in the center of the chest.

In this manner the overal effect, as above mentioned, will be to, in effect, exert differing weights intentions within the overal arm muscular system extending through the shoulder and to the neck. This will be a natural result of the weight pulling against the hand and the motions as mentioned.

While the embodiment of this invention particularly shown and described herein is fully capable of achieving the objects and advantages desired, it is to be understood that these particular embodiments are for purposes of illustration only and not for purposes of limitation.

I claim:

1. The method of providing an exercising device to be used by an individual comprising draping a strap over an upper arm being held at a substantially horizontal position; providing a weight on a first end of said strap, said end being the continuation of the portion draped over the upper arm which is outwardly from the shoulder and body; placing handle means on a second end of said strap, and gripping said handle means by the hand of the arm over which the strap is draped in such a position that the hand with the handle is approximately to the center and in front of the chest of the individual whose arm has the strap draped over it.

* * * * *